US009633636B1

(12) United States Patent
Campitelli

(10) Patent No.: US 9,633,636 B1
(45) Date of Patent: Apr. 25, 2017

(54) BASS DRUM ADAPTOR

(71) Applicant: Martin Thomas Campitelli, Penticton (CA)

(72) Inventor: Martin Thomas Campitelli, Penticton (CA)

( * ) Notice: Subject to any disclaimer, the term of this patent is extended or adjusted under 35 U.S.C. 154(b) by 0 days.

(21) Appl. No.: 15/221,037

(22) Filed: Jul. 27, 2016

(51) Int. Cl.
*G10D 13/02* (2006.01)

(52) U.S. Cl.
CPC ..... *G10D 13/028* (2013.01)

(58) Field of Classification Search
CPC ..... G10D 13/028; G10D 13/02
See application file for complete search history.

(56) References Cited

U.S. PATENT DOCUMENTS

| | | | | | |
|---|---|---|---|---|---|
| 2,563,346 | A * | 8/1951 | Livingston | G10D 13/026 | 84/412 |
| 2,858,724 | A * | 11/1958 | Troppe | G10D 13/02 | 84/411 R |
| 3,621,749 | A * | 11/1971 | Aluisi | G10D 13/028 | 84/411 R |
| 4,168,646 | A * | 9/1979 | May | G10D 13/02 | 84/411 R |
| 4,256,006 | A * | 3/1981 | Widener | G10D 13/02 | 84/411 R |
| 4,452,121 | A * | 6/1984 | Green | G10D 13/02 | 84/421 |
| 4,457,202 | A * | 7/1984 | DeBarbrie | G10D 13/02 | 84/411 R |
| 7,781,660 | B2 * | 8/2010 | Paterson | G10D 13/02 | 84/411 R |
| 8,193,434 | B2 * | 6/2012 | Ferguson | G10D 13/02 | 84/411 R |
| 8,263,847 | B2 | 9/2012 | Saravis | | |
| 8,415,547 | B1 * | 4/2013 | Albritton, Jr. | G10D 13/02 | 84/411 R |
| 8,642,866 | B1 | 2/2014 | Belli | | |
| 8,669,451 | B2 * | 3/2014 | Turner | G10D 13/02 | 84/411 R |
| 2010/0089220 | A1 * | 4/2010 | Alfonso | G10D 13/02 | 84/454 |
| 2012/0000343 | A1 | 1/2012 | Rothenberg | | |

FOREIGN PATENT DOCUMENTS

| | | |
|---|---|---|
| CA | 2873444 | 11/2013 |
| CN | 202871284 | 4/2013 |
| CN | 203192383 | 9/2013 |
| DE | 102009008755 | 8/2010 |

* cited by examiner

*Primary Examiner* — Robert W Horn
(74) *Attorney, Agent, or Firm* — Richard D. Okimaw

(57) ABSTRACT

An apparatus for adapting the size of a drum comprises a cylindrical body extending between first and second ends and having a central passage therethrough, the first end defining a first opening adapted to receive a first drum therein and the second end defining a second opening adapted to receive a second drum therein. A method for adapting the size of a drum comprises locating an input drum within a first opening through the first end and locating an output drum within a first opening through the second end. The input and output drums may have one face removed therefrom exposing an open end for insertion into the apparatus.

18 Claims, 4 Drawing Sheets

BASS DRUM ADAPTOR

BACKGROUND OF THE INVENTION

1. Field of Invention

The present invention relates generally to drums general and in particular to an apparatus for reducing the input size of the bass drum, while maintaining a larger outboard face.

2. Description of Related Art

Kick drums are bass drums which are played with a beater attached to a pedal, providing the deep bass sound in a music ensemble. Bass drums may be in the range of 16-40 inches in diameter and have two heads or faces. The inboard face of a kick drum is directed towards the percussionist while the outboard face is directed towards the audience. A membrane stretched over the inboard face resonates when impacted with the beater, and the vibrations within the drum subsequently vibrate another membrane stretched over the outboard face.

To allow a percussionist to play multiple percussion instruments at once, an assortment of instruments are physically arranged together in a drum kit or drum set. Drum kits include several percussion instruments, which often include the bass drum, played with a foot pedal, a snare drum mounted on a stand in front of the player and played with drum sticks, two or more toms, also on stands, played with sticks or brushes, a hi-hat cymbal played with a foot pedal, and one or more cymbals played with sticks. More or less percussion instruments may be included in the drum kit.

The drum kit is commonly arranged such that the percussionist can access all instruments from one position. This may require that some of the instruments are "stacked" so that they may be within reach. In many drum kits, the snare drum and toms are positioned very close to, or above, the bass drum, depending on the size of the drummer. When the bass drum diameter is large, the other instruments may not be easily stacked above it as the resulting elevation of the instruments could not be easily accessed by the percussionist. In this case, the bass drum may be shifted away from the percussionist, resulting in a longer leg reach to the pedal. Therefore, with a larger bass drum, the increased elevation of the stacked instruments or the extended leg reach to access the bass drum is an inconvenience for the percussionist. Conversely, however, smaller bass drums may be less desirable for some drum kits and drummers due to the higher frequency of such drums.

SUMMARY OF THE INVENTION

According to a first embodiment of the present invention there is disclosed a apparatus for adapting the size of a drum comprising a cylindrical body extending between first and second ends and having a central passage therethrough, the first end defining a first opening adapted to receive a first drum therein and the second end defining a second opening adapted to receive a second drum therein.

The first opening may be smaller than the second opening. The first opening may be axially offset from the second opening. An axis of the first opening may be lower than an axis of the second opening.

The first opening may be located in an entrance portion of the cylindrical body. The second opening may be located in an exit portion of the cylindrical body. The entrance portion may be positioned to have a bottom thereof proximate to a bottom of the exit portion.

The first opening may be secured to an input drum. The first opening may be sealed around the input drum. The second opening may be secured to an output drum. The second opening may be sealed round the output drum. The first and second opening may expand to distal edges thereof.

The apparatus may further comprise a frustoconical connecting portion between the entrance and exit sections.

According to a further embodiment of the present invention there is disclosed a method for adapting the size of a drum comprising providing a cylindrical body extending between first and second ends and having a central passage therethrough, locating an input drum within a first opening through the first end and locating an output drum within a first opening through the second end.

The input drum may have an output face removed from an output end thereof prior to insertion within the first opening. The output end of the input drum may be inserted into the first opening. The input drum may have an input face removed from an input end thereof prior to insertion within the second opening. The input end of the output drum may be inserted into the second opening.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
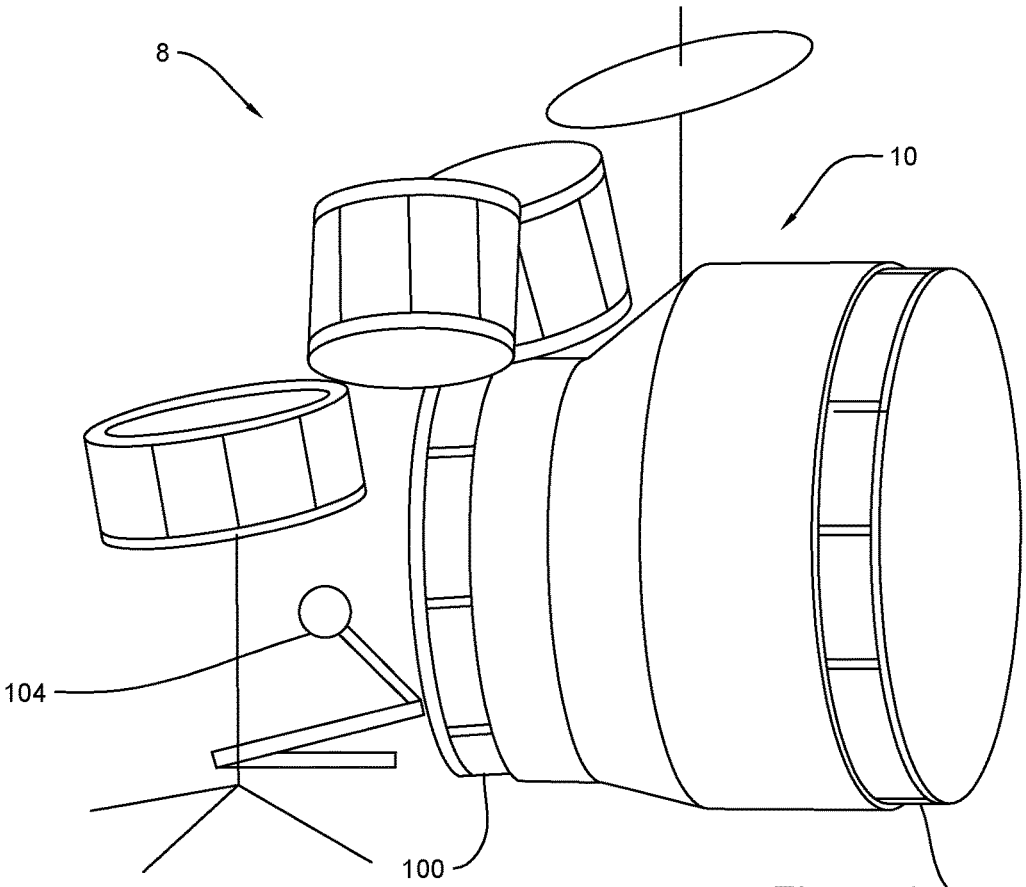
FIG. 1 is a perspective illustration of a drum kit with the apparatus installed on the bass drum.

Referring to FIG. 1, an apparatus for connecting two bass drums of differing diameters is generally shown at 10, installed within a drum set 8. A first or input drum 100 is positioned or aligned within a first end 12 of the drum adaptor 10, while a larger second or output drum 102 is positioned or aligned within a second end 14, as will be described in more detail below. The illustrated assembly allows for output drum 102 to be played using soundwaves generated when beater 104 strikes input drum 100, thereby producing a lower frequency sound than would result from the smaller diameter input drum 100 alone. By utilizing an input drum 100 of smaller diameter than output drum 102, the drum set can be configured as illustrated, with additional drums positioned above input drum 100, mounted by any known means, such as on a bass drum mount or on stands, by way of non-limiting example. Wherein such additional drums may be positioned lower than otherwise possible.

Figure 2:
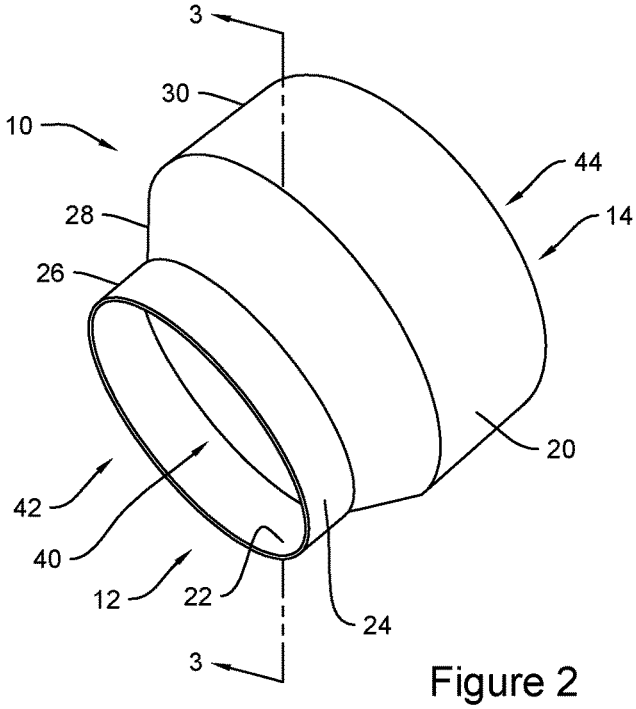
FIG. 2 is a perspective view of the kick drum adaptor.
Figure 3:
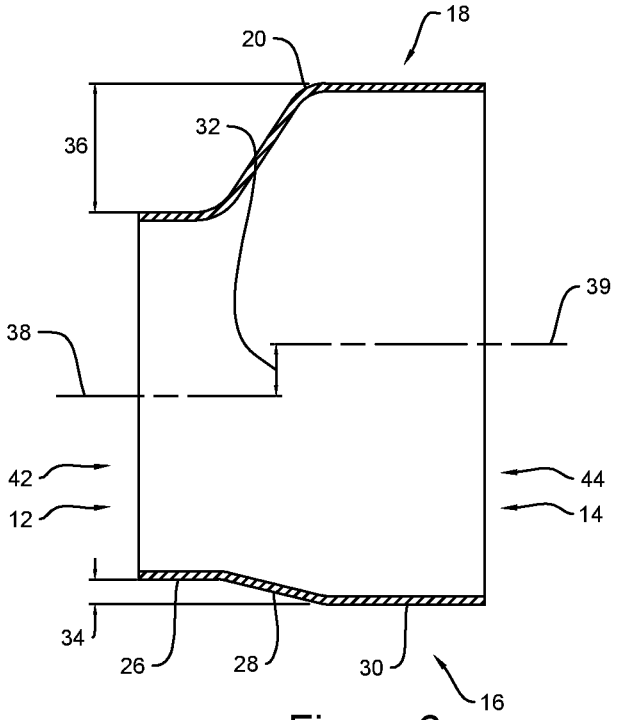
FIG. 3 is a cross sectional view of the kick drum adaptor of FIG. 2 as taken along the line 3-3 of FIG. 2.
Figure 4:
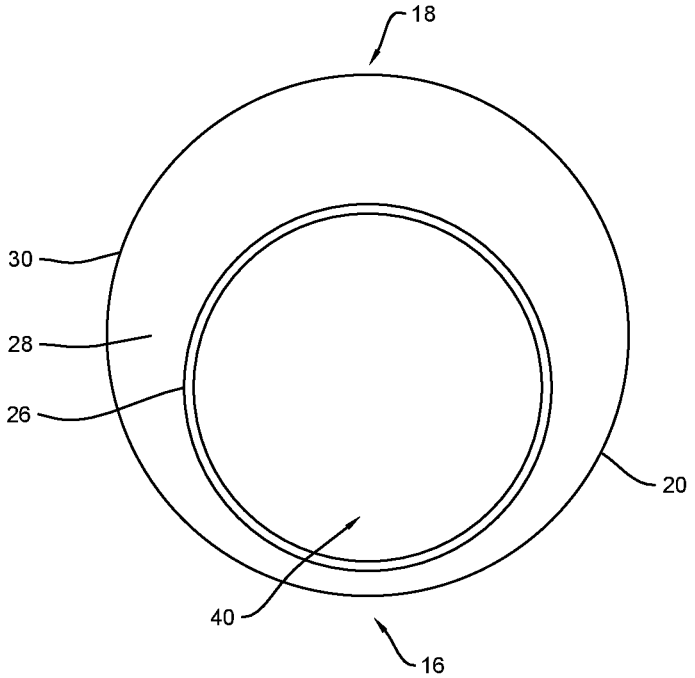
FIG. 4 is an end view of the kick drum adaptor of FIG. 2.

Turning to FIGS. 2 through 4, an apparatus 10 for connecting two bass drums of differing diameters comprises a body 20 extending between first and second ends, 12 and 14, respectively, with a bottom generally indicated at 16 and a top generally indicated at 18. The body 20, has an interior surface 22 and an exterior surface 24, and is comprised of an input portion 26 extending along an input axis 38 proximate to first end 12, an output portion 30 extending along an output axis 39 proximate to the second end 14, with a middle transition portion 28 therebetween. Input portion 26 and output portion 30 are both cylindrical in shape, with middle transition portion 28 having a generally oblique frustoconical shape, which may have an offset distance 32 between the input axis and output axis 38 and 39, as shown in the illustrated embodiment. By way of non-limiting example, the offset distance may selected to be up to 8 inches (203 mm) although it will be appreciated that other dimensions may be useful to permit the input drum 100 to be spaced above the ground by a distance sufficient to facilitate being struck by a beater as is commonly known. Middle transition portion 28 could be stepped or have any other shape, as well.

The inner surface 22 of the body 20 defines an interior passage 40 therethrough having entrance opening 42 and exit opening 44. The diameter of entrance opening 42 is less than the diameter of the exit opening 44, with the middle transition portion 28 having a gradually increasing diameter, from a starting diameter equal to that of the diameter of input portion 26 to an ending diameter equal to that of the diameter of output portion 30. The diameter of entrance opening 42 is sized such that the shell of input drum 100 fits within, allowing a slip fit. The diameter of exit opening 44 is sized such that the shell of output drum 102 fits within, allowing a slip fit. By way of non-limiting example the difference between such diameters may be selected to be up to ½ inch (13 mm) although it will be appreciated that other distances may be useful as well. As noted, the middle transition portion 28 may have an offset distance 32, as best shown in FIG. 3. The offset distance 32 is such that the lower edges of input drum 100 and output drum 102 proximate to bottom 16 are offset a small distance, bottom offset distance 34, such as, by way of non-limiting example, up to 8 inches (203 mm), raising input drum 100 off of the floor to allow for optimal placement of the foot pedal and beater 104, while output drum 102 rests on the floor at bottom 16, whereas the top offset distance 36 between the upper edges of input drum 100 and output drum 102 is larger, by way of non-limiting example, up to 16 inches (406 mm), although it will be appreciated that other offset distances may be useful, as well, depending on the diameters of input and output drums 100, 102.

The length of body 20 may be, such as, by way of non-limiting example, in the range of 6-20 inches (152-508 mm), although it may be appreciated that other lengths may be useful, as well depending upon the size of the drums used as well the method of connecting thereto. The length of input portion 26 may be such as, by way of non-limiting example, in the range of 2 to 10 inches (51 to 254 mm), to allow for installation of the input drum 100. The length of output portion 30 may be such as, by way of non-limiting example, in the range of 2 to 10 inches (51 to 254 mm), to allow for installation of the output drum 102. The length of middle transition portion 28 may be such as, by way of non-limiting example, example, up to 16 inches (406 mm) although other distances may also be selected depending upon the transition shape and sizes of the input and output drums.

Figure 5:
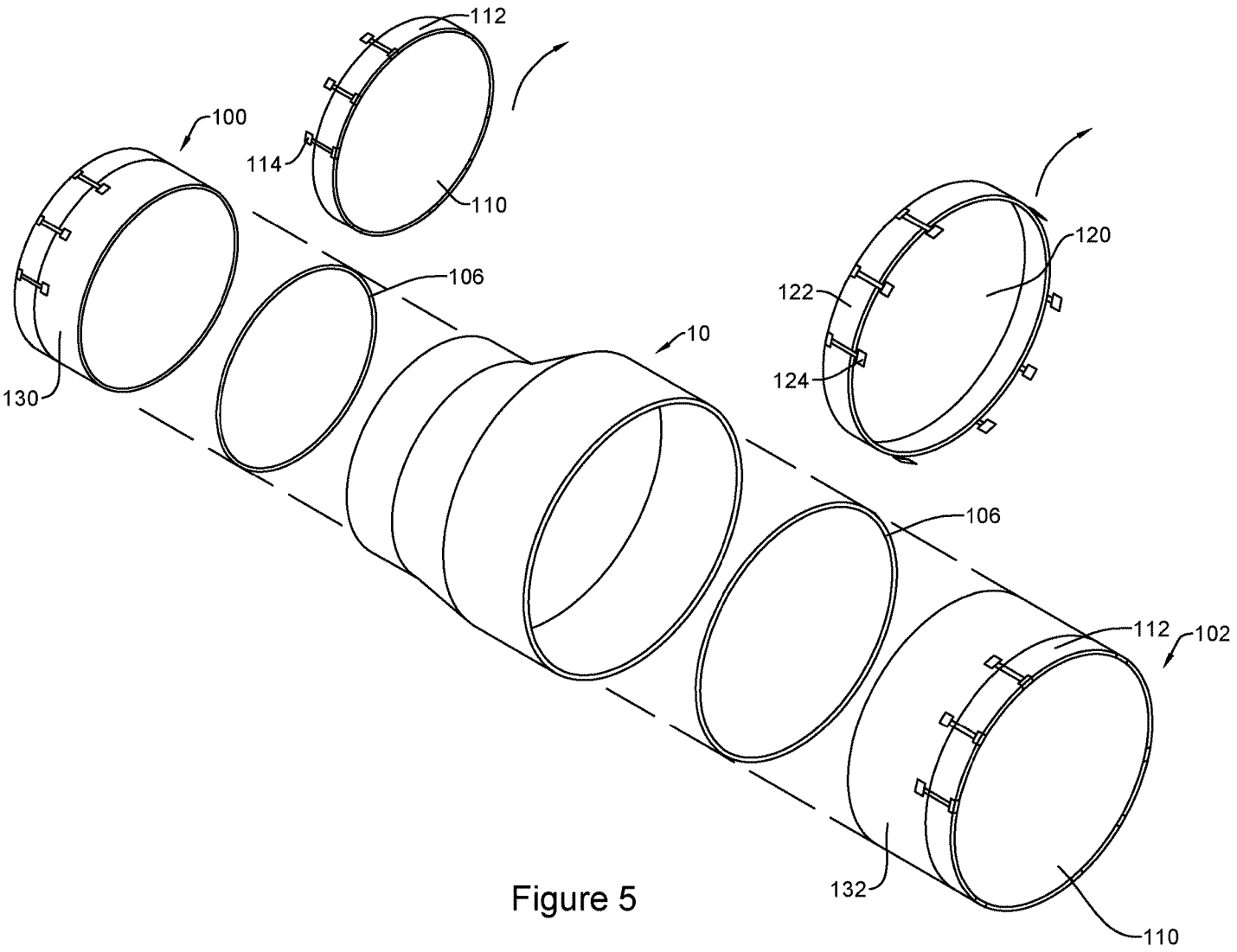
FIG. 5 is an exploded view of a drum assembly of FIG. 1.

FIG. 5 illustrates an exploded view of the assembly of the bass drum of FIG. 2. To fit the drums 100, 102 into the drum adaptor 10, the output head 110, output head hoop 112 and the plurality of output head mounting lugs 114 of the input drum 100 must be removed prior to assembly. Output drum 102 is a similar configuration to input drum 100; the input batter head 120, input batter head loop 122 and the plurality of input batter head mounting lugs 124 of the output drum 102 must be removed prior to assembly. The shell 130 of input drum 100 is engaged within input portion 26 through entrance opening 42, leaving the input batter head 120 and associated mounting parts exterior to the drum adaptor 10. The body 20 may also include one or more gasket 106 applied to the interior surface 22 within input portion 26 to allow for a sealed fit of input drum 100. Fasteners 108, as commonly known may also be included on the exterior surface 24 of input portion 26, to which the drum shell 130 may be secured by any known means. The shell 132 of output drum 102 is engaged with exit opening 44, leaving the output head 110 and associated mounting parts exterior to drum adaptor 10. The body may also include one or more gasket 106 applied to the interior surface 22 within output portion 30 to allow for a sealed fit of output drum 102. Fasteners 108 as commonly known in the art may be included on the exterior surface 24 of output portion 30, to which the drum shell 132 may be secured by any known means. Although the illustrated embodiment of the invention allows for two bass drums to be mounted within drum adaptor 10, it can be appreciated that the drum adaptor 10 could be configured in an alternate embodiment, including mounting lugs secured to the drum adaptor body 20 such that the input batter head 120, input batter head hoop 122, output head 110 and output head hoop 112 may be mounted directly onto drum adaptor 10. It will also be appreciated that although the input and output drums are illustrated as being full length, the length of such drums may be shortened by removing a portion of the open ends thereof to reduce the overall length of the finished assembly. Body 20 may range in thickness from 1/32 to ½ inches (1 to 13 mm). Body 20 may be comprised of a wide variety of materials, such as, by way of non-limiting example, fiberglass, wood, composite wood fibre and resin or plastic, although it may be appreciated that other materials may be useful, as well. The body may be formed by any known method, such as, by way of non-limiting example, molding or machining. It will also be appreciated that the body 20 may be co-formed with the drums as a unitary construction.

Figure 6:
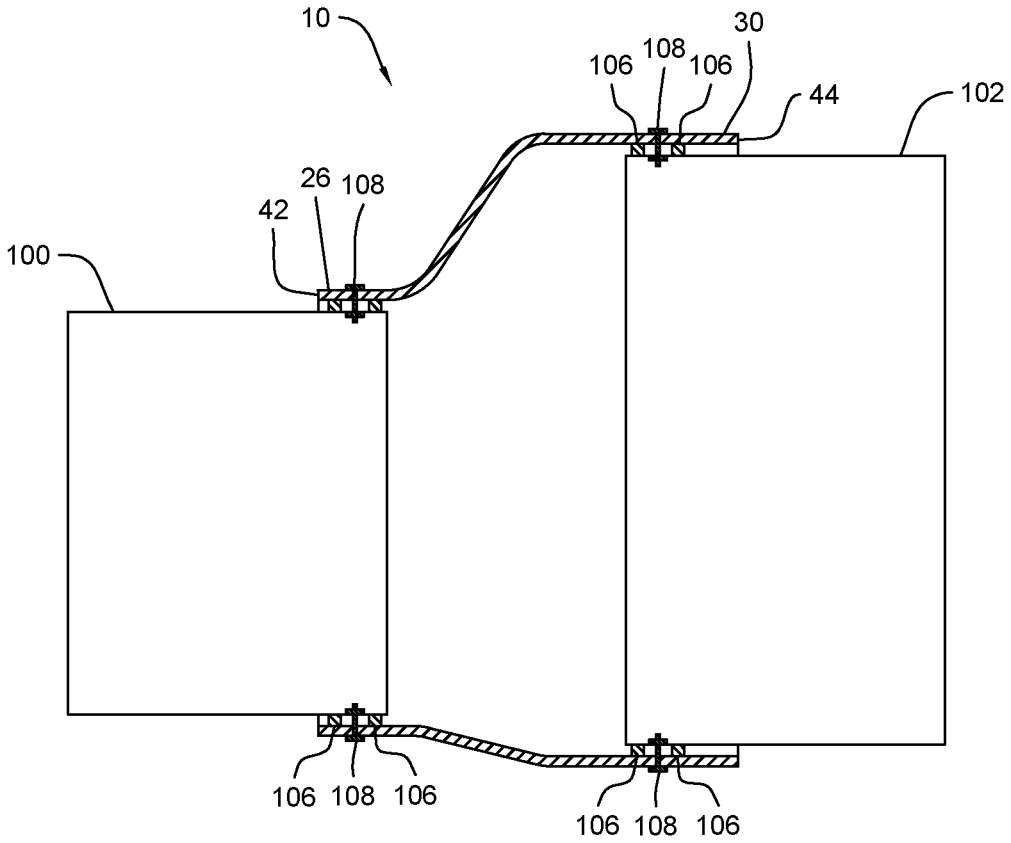
FIG. 6 is a cross sectional view of drum assembly of FIG. 1 according to a further embodiment.

Turning now to FIG. 6, a cross sectional view of the assembled drum is illustrated. As illustrated in FIG. 6, the body 20 may include one or more gaskets 106 on each of the input and output portions 26 and 30 to provide a sealed fit with the input and output drums 100 and 102. The gaskets 106 may be adhered in place or otherwise secured between the body and the drums in by any known method. It will also be appreciated that other sealing methods may also be used. Although two gaskets are illustrated in FIG. 6, it will be appreciated that one or more than two on each end may also be useful. After insertion of the input and output drums therein, fasteners 108 may be passed through bores 109 in body 20 to pass through corresponding bores in the drums. It will be appreciated that the bores in the drums may comprise existing drums utilized for the previous assembly of the drum or may comprise newly bored holes therethrough for assembly with the body 20. As set out above, the input and output portions 26 and 30 of the body may be substantially cylindrical. As illustrated in FIG. 6, however, one or both of these portions may include a widening taper so as to be larger at the entrance and/or exit opening 42 and 44. Such taper will facilitate ease of installation of the drums therein and ensure a snug fit by permitting the drum to be pressed into the body 20 until such a snug fit is reached. By way of non-limiting example it has been found that a taper of up to 1 inch (25 mm) increase in diameter has been useful although it will be appreciated that other dimensions may be useful as well.

While specific embodiments of the invention have been described and illustrated, such embodiments should be considered illustrative of the invention only and not as limiting the invention as construed in accordance with the accompanying claims.

What is claimed is:

1. An apparatus for adapting the size of a drum comprising:

a cylindrical body extending between first and second ends and having a central passage therethrough, said first end defining a first opening adapted to receive a first drum therein; and said second end defining a second opening adapted to receive a second drum therein.

2. The apparatus of claim 1 wherein said first opening is smaller than said second opening.

3. The apparatus of claim 2 wherein said first opening is axially offset from said second opening.

4. The apparatus of claim 3 wherein an axis of said first opening is lower than an axis of said second opening.

5. The apparatus of claim 1 wherein said first opening is located in an entrance portion of said cylindrical body.

6. The apparatus of claim 5 wherein said second opening is located in an exit portion of said cylindrical body.

7. The apparatus of claim 6 wherein said entrance portion is positioned to have a bottom thereof proximate to a bottom of said exit portion.

8. The apparatus of claim 1 wherein said first opening is secured to an input drum.

9. The apparatus of claim 8 wherein said first opening is sealed around said input drum.

10. The apparatus of claim 1 wherein said first and second openings expand to distal edges thereof.

11. The apparatus of claim 1 wherein said second opening is secured to an output drum.

12. The apparatus of claim 11 wherein said second opening is sealed around said output drum.

13. The apparatus of claim 6 further comprising a frustoconical connecting portion between said entrance and exit sections.

14. A method for adapting the size of a drum comprising:

providing a cylindrical body extending between first and second ends and having a central passage therethrough, locating an input drum within a first opening through said first end; and locating an output drum within a first opening through said second end.

15. The method of claim 14 wherein said input drum has an output face removed from an output end thereof prior to insertion within said first opening.

16. The method of claim 15 wherein said output end of said input drum is inserted into said first opening.

17. The method of claim 14 wherein said input drum has an input face removed from an input end thereof prior to insertion within said second opening.

18. The method of claim 16 wherein said input end of said output drum is inserted into said second opening.

* * * * *